US008245988B2

(12) United States Patent
Hoernig

(10) Patent No.: US 8,245,988 B2
(45) **Date of Patent: *Aug. 21, 2012**

(54) BATH FIXTURE MOUNTING METHOD

(75) Inventor: Victor Hoernig, Lowell, IN (US)

(73) Assignee: Masco Bath Corporation, Moorestown, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/273,515

(22) Filed: Oct. 14, 2011

(65) Prior Publication Data

US 2012/0030923 A1 Feb. 9, 2012

Related U.S. Application Data

(63) Continuation of application No. 12/512,294, filed on Jul. 30, 2009, now Pat. No. 8,104,726.

(51) Int. Cl.
*A47B 96/06* (2006.01)

(52) U.S. Cl. ..... 248/220.22; 248/223.41; 248/231.91; 4/559; 4/571.1; 4/576.1

(58) Field of Classification Search ..... None
See application file for complete search history.

(56) References Cited

U.S. PATENT DOCUMENTS

| | | | |
|---|---|---|---|
| 3,414,910 | A | 12/1968 | Provi et al. |
| 4,352,478 | A | 10/1982 | Loew |
| 5,101,989 | A | 4/1992 | Jones |
| 5,337,525 | A | 8/1994 | Zaccai et al. |
| 5,676,258 | A | 10/1997 | Leyden et al. |
| 5,697,592 | A | 12/1997 | Matheny |
| 6,036,149 | A | 3/2000 | Del Pino et al. |
| 6,311,854 | B1 | 11/2001 | Anderson |
| 2005/0274855 | A1 | 12/2005 | Shin |
| 2006/0266900 | A1 | 11/2006 | May et al. |
| 2008/0197253 | A1 | 8/2008 | Thompson |
| 2009/0050763 | A1 | 2/2009 | Dittmer |
| 2009/0108157 | A1 | 4/2009 | Spencer |
| 2009/0214318 | A1 | 8/2009 | Bowden et al. |
| 2010/0126953 | A1 | 5/2010 | Lin |

FOREIGN PATENT DOCUMENTS

| | | |
|---|---|---|
| JP | 4368571 | 12/1992 |

OTHER PUBLICATIONS

International Search Report & Written Opinion dated Feb. 22, 2011.
International Preliminary Report on Patentability dated Sep. 23, 2011.

*Primary Examiner* — Bradley Duckworth
(74) *Attorney, Agent, or Firm* — Carlson, Gaskey & Olds PC

(57) ABSTRACT

A method for installing an accessory for a bath includes attaching a first mounting bracket to a structure; placing the accessory on a first side of a system wall that is visible after installation; placing a second mounting bracket on a second side of the system wall that is not visible after installation; attaching the accessory to the second mounting bracket through the system wall; and attaching the second mounting bracket to the first mounting bracket wherein the system wall has a first portion that is both parallel to the structure and extends above the first mounting bracket and the second mounting bracket, and a second portion that is both parallel to the structure and extends below the first mounting bracket and the second mounting bracket.

9 Claims, 3 Drawing Sheets

BATH FIXTURE MOUNTING METHOD

REFERENCE TO RELATED APPLICATIONS

This application is a continuation of U.S. patent application Ser. No. 12/512,294, which was filed Jul. 30, 2009 now U.S. Pat. No. 8,104,726 and is incorporated herein by reference.

BACKGROUND OF THE INVENTION

Bath accessories, such as grab bars, typically have a plurality of mounting flanges to mount the accessory on a wall surface or the like. Covers are used on the accessories to conceal the mounting flanges. Typically, accessories are installed after the bathing system is installed making it difficult to attach the grab bar or other accessory to studs through a bathing system or other wall.

Other bath accessories, like seats, are also mounted through bath system walls.

SUMMARY OF THE INVENTION

According to an example shown herein, a method for installing an accessory for a bath includes attaching a first mounting bracket to a structure; placing the accessory on a first side of a system wall that is visible after installation; placing a second mounting bracket on a second side of the system wall that is not visible after installation; attaching the accessory to the second mounting bracket through the system wall; and attaching the second mounting bracket to the first mounting bracket wherein the system wall has a first portion that is both parallel to the structure and extends above the first mounting bracket and the second mounting bracket, and a second portion that is both parallel to the structure and extends below the first mounting bracket and the second mounting bracket.

According to a further example, a method for installing an accessory for a bath, includes preinstalling in a first location, placing the accessory on a first side of a system wall that is visible after installation, placing a second mounting bracket on a second side of the system wall that is not visible after installation, and attaching the accessory to the second mounting bracket through the system wall. In a second location, the method includes the steps of attaching a first mounting bracket to a structure and attaching the first mounting bracket and the second mounting bracket to each other.

According to a still further example, a method for installing an accessory includes, in a first location, the steps of placing the accessory on a side of a system wall that is visible after installation, placing a first mounting bracket on a second side of the system wall that is not visible after installation, and attaching the accessory to the first mounting bracket through the system wall. In a second location, the method includes the steps of attaching a second mounting bracket to a structure, and attaching the second mounting bracket and the first mounting bracket to each other.

Other objects, features and advantages of the invention will be apparent from the following detailed description taken in connection with the accompanying drawings.

BRIEF DESCRIPTION OF THE DRAWINGS

The present invention will be more fully understood by reference to the following detailed description of a preferred embodiment when read in conjunction with the accompanying drawing, in which like reference characters refer to like parts throughout the views and in which.

DETAILED DESCRIPTION OF THE PREFERRED EMBODIMENT OF THE PRESENT INVENTION

Figure 1:
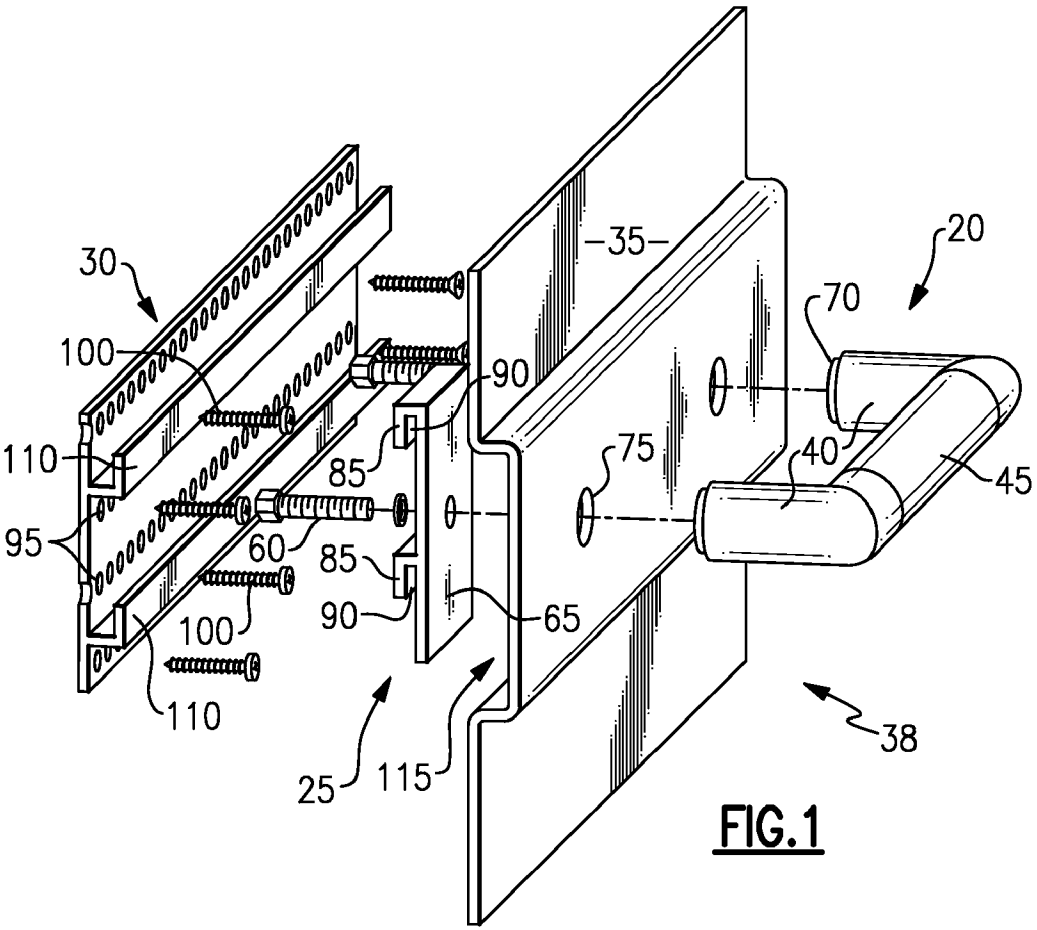
FIG. 1 is a schematic cross-sectional view of a system incorporating the present invention.
Figure 2:
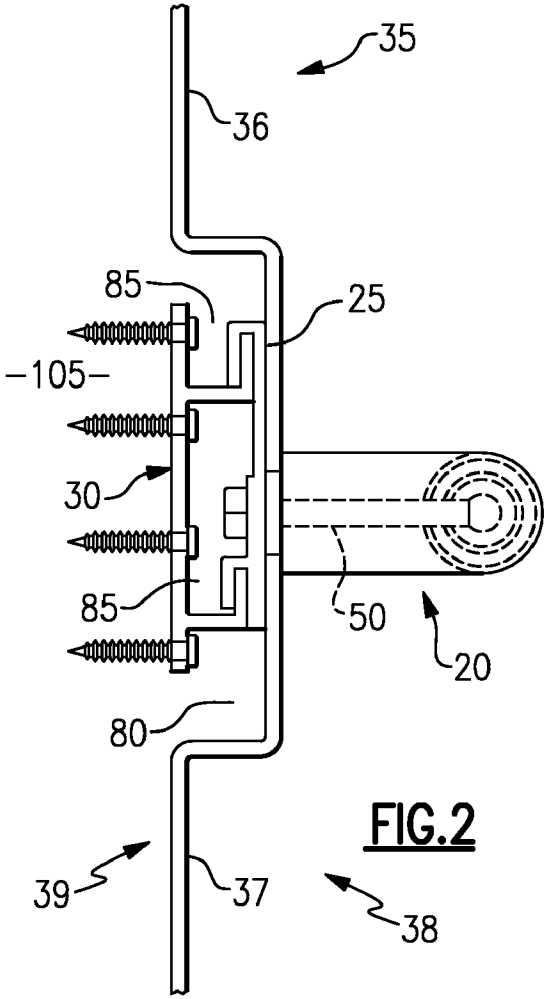
FIG. 2 is a side cross-sectional view of an installed accessory such as a grab bar of FIG. 1.

Referring to FIGS. 1 and 2, the system 10 of the invention is shown. The system, shown herein as a bath system, consists of an accessory, such as grab bar 20, a second mounting bracket 25 and a first mounting bracket 30. The grab bar, the first and second mounting brackets are adapted to cooperate with a shower wall 35, which may be metal, plastic or other suitable material, as will be discussed herein. One of ordinary skill in the art will recognize that other accessories may be mounted to a system, like a flip down seat among others, as will be discussed herein. The shower wall has a side 38 that is visible after installation and a side 39 that is not visible after installation.

The grab bar 20 is shaped like a typical handle with a pair of legs 40 that abut the shower wall 35 and a connecting arm 45 that connects both legs as is known in the art. The legs 40 of the grab bar each have a threaded interior portion 50 thereof that receives a socket head screw 60, and a cylindrical portion 70 extending through a mating cylindrical hole 75 in the shower wall 35.

The second mounting bracket 25 may be made of metal, plastic or other suitable material, and has a base 65. The cylindrical portion 70 of the grab bar extends through the hole 75 in the shower wall 35. The socket head screw 60 and the threaded interior portion 50 of the grab bar legs 40 cooperate to connect the second mounting bracket to the grab bar 20 through the shower wall 35 and to align the shower wall and the legs 40 of the grab bar. One of ordinary skill in the art will recognize that other shapes for the cylindrical portion 70 and the hole 75 in the wall 35 may be appropriate. In the embodiment shown, the base 65 may also be bonded to the shower wall by known means such as glue. The second mounting bracket 25 on its side opposite from the cylindrical portion 70 of the legs 40 has a pair of longitudinally extending L-shaped flanges 85 disposed thereon that form a pair of slots 90 therein.

The socket head screws may attach the second mounting bracket 25 to the grab bar 20 before the shower wall is shipped to a job site.

The first mounting bracket 30 has two sets of longitudinally extending holes 95 that extend along the length of the bracket, one above the other, to accept screws 100 to attach the first mounting bracket to wall studs 105 (see FIG. 2). The first mounting bracket also has a pair of longitudinally extending L-shaped extensions 110 that are adapted to mate with the L-shaped slots 90 of the small mounting bracket 25. In essence, the first mounting bracket L-shaped extensions 110 form rails which mate with the slots 90 of the brackets if the wall grab bar and bracket assembly is placed for assembly on the second mounting bracket 30. One of ordinary skill in the art will recognize that other shapes of the L-shaped extension may be employed for cooperation between the two brackets.

By using the teachings of this invention, there is no requirement to align a grab bar 20 with a stud while guessing whether the other end of the grab bar will align with a second stud. If the second end of a grab bar does not align with a second stud, other techniques, such as bolting or heavy-duty screws, may be required. Bolting and screws require the grab bar to have a decorative flange (not shown) to cover the bolts. In this invention, no such unsightly flanges are required.

The shower wall 35 has a longitudinal indentation 115 for receiving the brackets 25 during assembly so that the shower wall can be flush with the studs for installation thereon, thereby easing the installation of the shower wall.

FIG. 2 shows a cross-sectional view of a first mounting bracket anchored to a stud 105, the second mounting bracket extensions 110 are inserted into a bracket's slots 90, and the bracket 25 is attached to the grab bar 20 by socket head screws 60 within the shower wall indentation 115 such that the shower wall 35 is flush with the stud.

Figure 3:
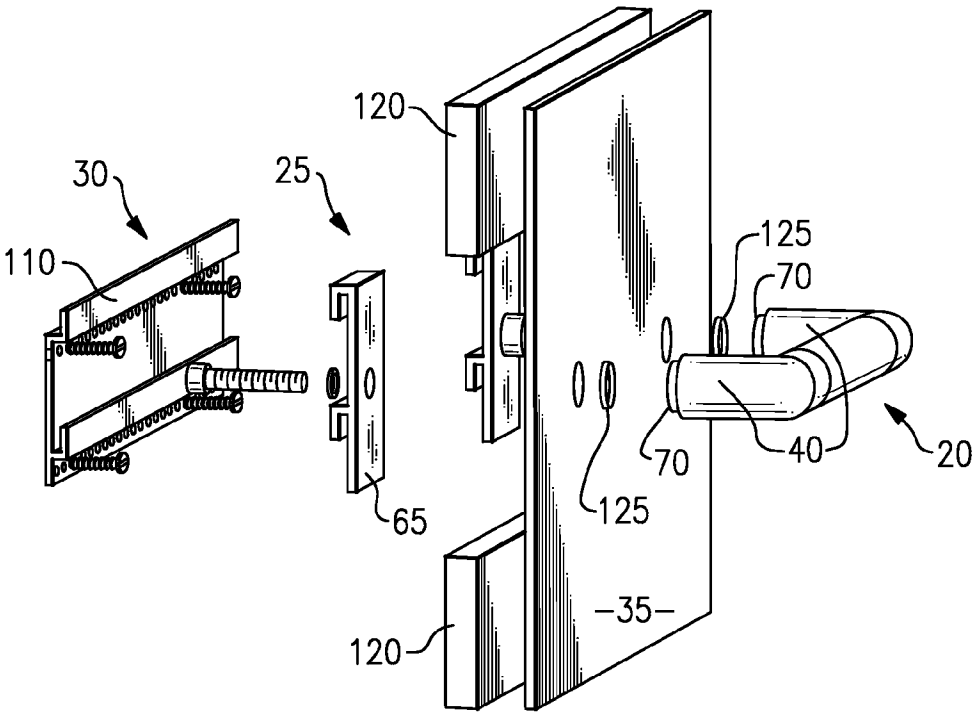
FIG. 3 is a further embodiment of an accessory, such as a grab bar, incorporating the present invention.
Figure 4:
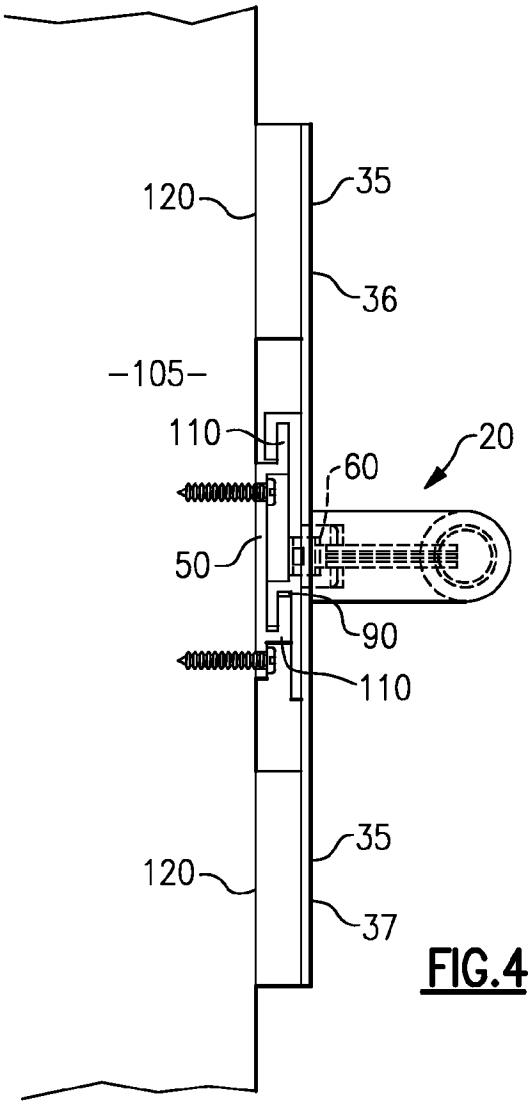
FIG. 4 is a cross-sectional view of the embodiment of an accessory such as a grab bar, of FIG. 3.

Referring now to FIGS. 3 and 4, a second embodiment of the invention is shown. In this version, the wall has no longitudinal indentation 115 (see FIGS. 1 and 2) so the wall cannot be installed flush to the studs 105. However, a number of filler boards 120 made of plastic or wood is placed on the shower wall to permit a user to install the shower wall to the studs in a parallel manner without concern to the inwardly projecting bracket 25. A gasket 125 is disposed between the shower wall 35 and each leg of the grab bar to create a seal therebetween.

Referring to FIG. 4, shows a cross-sectional view of a first mounting bracket 30 anchored to a stud, the bracket extensions 110 inserted into a second mounting bracket's slots 90, and the bracket attached to the grab bar 20 by socket head screw 60. Because there is no shower wall indentation, the filler board 120 allows the shower wall to be parallel to the studs.

During assembly, a user unpacks the shower wall 35 that has its brackets and filler material 120, if needed, preinstalled. The grab bar may be preinstalled off site or installed on site depending on shipping requirements. An installer then determines the ideal position of the shower wall and installs the first mounting bracket 30 to the studs 105 to attach the wall 35 thereto. A user simply pushes the wall onto the first mounting bracket 30 where the slot 90 of the small mounting bracket 25 is above the L-shaped extension 110 of the first mounting bracket and lets the wall fall so that the rails of the first mounting bracket are inserted in the slots 90 of the bracket, thereby anchoring the grab bar and the wall in place. The user may then, depending on the wall, choose to nail the bathing system wall to the studs. A user may also choose to align the slot of the bracket is at the side of the L-shaped extension and then slid therealong to mate with the first mounting bracket.

Figure 5:
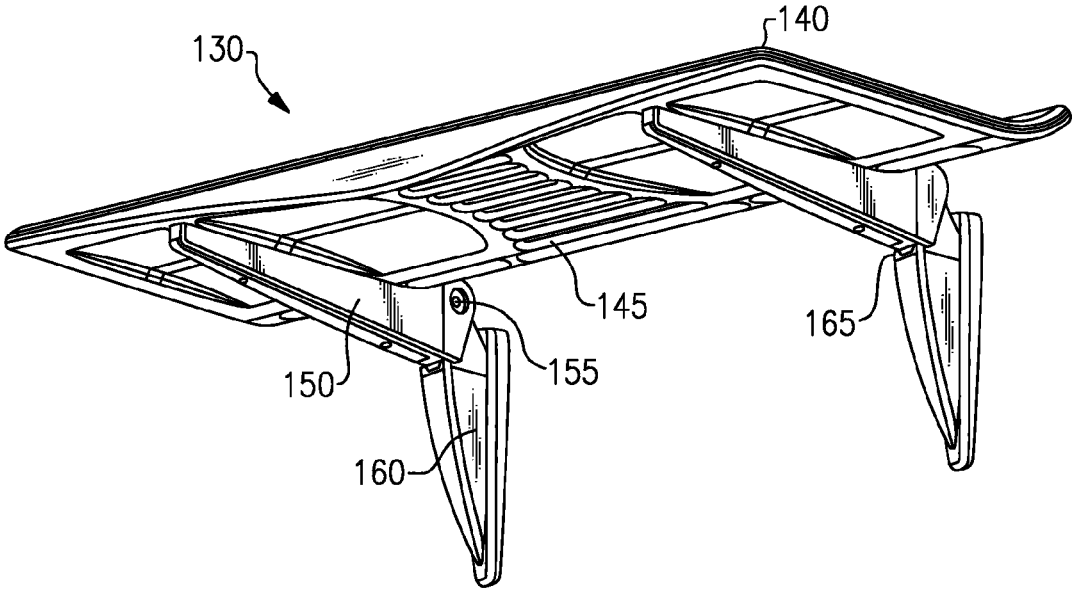
FIG. 5 is a prospective view of a further embodiment of an accessory of the invention such as a shower seat.
Figure 6:
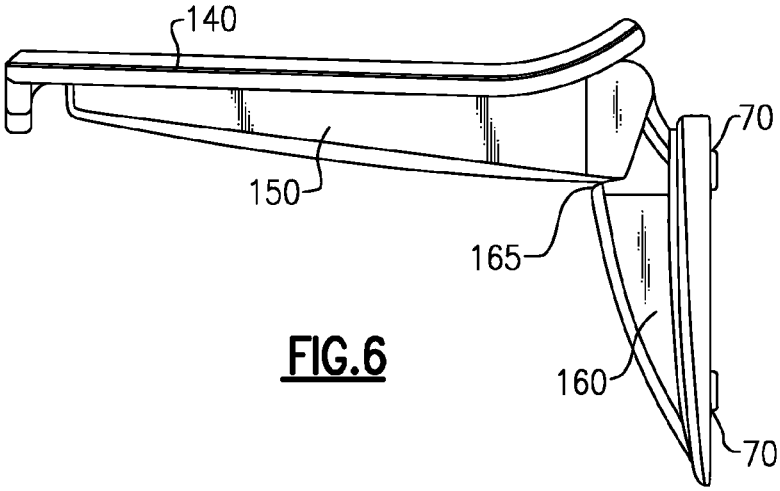
FIG. 6 is a further cross-sectional view of the embodiment of the shower seat of FIG. 5.

Referring now to FIGS. 5 and 6, the system of the invention is shown with a different accessory, a shower seat 130. The shower seat 130 has a flat body with a plurality of hygienic slots 145 through which a user may spray water to wash the user's bottom etc. (not shown). The seat has a pair of supports 150 that attach to a pair of stanchions 160 by conventional hinges 155. Each stanchion has a rest portion 165 which prevents the seat from over-rotating and for maintaining a relatively level position.

As with the grab bar, each stanchion has a cylindrical portion 70 that extends through the hole 75 in the shower wall 35 (see FIGS. 1-4). The socket head screw 60 and the threaded interior portion 50 of the grab bar legs 40 cooperate to connect the second mounting bracket to the grab bar 20 through the shower wall 35 and to align the shower wall and the legs 40 of the grab bar. One of ordinary skill in the art will recognize that other shapes for the cylindrical portion 70 and the hole 75 in the wall 35 may be appropriate. In the embodiment shown, the base 65 may also be bonded to the shower wall by known means such as glue. The second mounting bracket 25 on its side opposite from the cylindrical portion 70 of the legs 40 has a pair of longitudinally extending L-shaped flanges 85 disposed thereon that form a pair of slots 90 therein. In this embodiment, the first and second mounting brackets may be larger and have two openings for receiving socket head screws 60; or, two sets of first and second mounting brackets may be required to accommodate each cylindrical portion 70.

The socket head screws may attach the seat 130 to the second mounting bracket(s) 25 before the shower wall is shipped to a job site.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. Method for installing an accessory for a bath, said method comprising:

attaching a first mounting bracket to a structure;

placing said accessory on a first side of a system wall that is visible after installation;

attaching a second mounting bracket that is separated from said first mounting bracket to a second side of the system wall that is not visible after installation;

attaching said accessory to said second mounting bracket through the system wall; and attaching said second mounting bracket to said first mounting bracket wherein said system wall has a first portion that is both parallel to said structure and extends above said first mounting bracket and said second mounting bracket, and a second portion that is both parallel to said structure and extends below said first mounting bracket and said second mounting bracket.

2. The method of claim 1 wherein said method comprises:

inserting a portion of said second mounting bracket through said wall and into a female portion of said accessory.

3. The method of claim 1 wherein said method further comprises:

aligning said wall with said second mounting bracket attached thereto with said first bracket, and manipulating said wall and said second mounting bracket such that said second mounting bracket is attached to said first mounting bracket.

4. The method of claim 3 wherein the step of attaching said second mounting bracket to said first mounting bracket includes lifting said wall and said second mounting bracket above said first mounting bracket and dropping the wall and said second mounting bracket down on said first mounting bracket thereby mating therewith.

5. The method of claim 3 wherein the step of attaching said second mounting bracket to said first mounting bracket includes aligning said wall and said second mounting bracket on a side of said first mounting bracket and sliding the wall and said second mounting bracket along said first bracket thereby mating therewith.

6. The method of claim 1 wherein said accessory is a grab bar.

7. The method of claim 1 wherein said accessory is a seat.

8. Method for installing an accessory for a bath, said method comprising:

preinstalling in a first location, placing said accessory on a first side of a system wall that is visible after installation, attaching a second mounting bracket that is separated from said first mounting bracket to a second side of the system wall that is not visible after installation, attaching said accessory to said second mounting bracket through the system wall, and, in a second location, attaching a first mounting bracket to a structure, and attaching said first mounting bracket and said second mounting bracket to each other.

9. Method for installing an accessory, said method comprising:

in a first, offsite location, placing said accessory on a first side of a system wall that is visible after installation, attaching a second mounting bracket that is separated from a first mounting bracket to a second side of the system wall that is not visible after installation, attaching said accessory to said first mounting bracket through the system wall, and, in a second, onsite location, attaching a first mounting bracket to a structure, and attaching said second mounting bracket and said first mounting bracket to each other.

* * * * *